US012012252B2

(12) United States Patent
Benito Huertas et al.

(10) Patent No.: US 12,012,252 B2
(45) Date of Patent: Jun. 18, 2024

(54) EASY-ACCESS STORAGE RACK

(71) Applicant: SAINT-GOBAIN GLASS FRANCE, Courbevoie (FR)

(72) Inventors: Francisco José Benito Huertas, L'Arboç Tarragona (ES); Alberto Martinez De Pablo, Cubellas Barcelona (ES)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 236 days.

(21) Appl. No.: 17/442,999

(22) PCT Filed: Mar. 25, 2020

(86) PCT No.: PCT/EP2020/058396
§ 371 (c)(1),
(2) Date: Sep. 24, 2021

(87) PCT Pub. No.: WO2020/193645
PCT Pub. Date: Oct. 1, 2020

(65) Prior Publication Data

US 2022/0169418 A1 Jun. 2, 2022

(30) Foreign Application Priority Data

Mar. 27, 2019 (FR) ..... 1903198

(51) Int. Cl.
*B65D 19/06* (2006.01)
*B65D 19/44* (2006.01)
*B65D 85/48* (2006.01)

(52) U.S. Cl.
CPC ..... *B65D 19/44* (2013.01); *B65D 19/06* (2013.01); *B65D 85/48* (2013.01);
(Continued)

(58) Field of Classification Search
CPC ..... B65D 19/06; B65D 19/44; B65D 85/48; B65D 2519/00273; B65D 2519/00293;
(Continued)

(56) References Cited

U.S. PATENT DOCUMENTS 2,998,141 A * 8/1961 Moore ..... B65D 85/48 108/53.5
3,147,860 A * 9/1964 Kean, Sr. ..... B65G 49/062 108/53.5

(Continued)

FOREIGN PATENT DOCUMENTS

EP 216690 A * 4/1987 ..... B65D 85/48
KR 2021107441 A * 9/2021 ..... B65D 19/06

(Continued)

OTHER PUBLICATIONS

International Search Report as issued in International Patent Application No. PCT/EP2020/058396, dated May 12, 2020.

*Primary Examiner* — Joshua E Rodden
(74) *Attorney, Agent, or Firm* — Pillsbury Winthrop Shaw Pittman LLP

(57) ABSTRACT

A rack for storing and/or transporting elements, in particular glazing elements, of the type including a structure provided with a receiving device capable of receiving and holding these elements and with a frontal protection device. This rack is characterized in that the protection device is able to occupy two positions, namely a deployed position in which the device blocks access to the interior of the rack and a retracted position in which the device allows free access to the latter.

11 Claims, 5 Drawing Sheets

(52) U.S. Cl.
CPC ..... *B65D 2519/00273* (2013.01); *B65D 2519/00293* (2013.01); *B65D 2519/00323* (2013.01); *B65D 2519/00502* (2013.01); *B65D 2519/00532* (2013.01); *B65D 2519/00562* (2013.01); *B65D 2519/00616* (2013.01); *B65D 2519/00666* (2013.01); *B65D 2519/00815* (2013.01); *B65D 2519/0082* (2013.01)

(58) Field of Classification Search
CPC ..... B65D 2519/00323; B65D 2519/00502; B65D 2519/00532; B65D 2519/00562; B65D 2519/00616; B65D 2519/00666; B65D 2519/00815; B65D 2519/0082
USPC ..... 211/41.14, 41.15, 41.16, 189, 191, 192, 211/195, 206; 206/448, 449, 454
See application file for complete search history.

(56) References Cited

U.S. PATENT DOCUMENTS 3,193,093 A * 7/1965 Hansen ..... B65G 49/062 108/53.5
3,809,234 A * 5/1974 Kurick ..... B65D 85/48 206/451
3,938,660 A * 2/1976 Moehring ..... B65D 19/08 206/451
3,946,876 A * 3/1976 Jay ..... B65D 19/08 211/195
4,010,849 A * 3/1977 Pater ..... B65D 85/48 206/451
4,934,538 A * 6/1990 Beyer ..... B65G 49/062 211/49.1
5,378,093 A * 1/1995 Schroeder ..... B61D 45/006 410/43
6,123,208 A * 9/2000 Haenszel ..... B65D 85/68 211/208
7,270,236 B2 * 9/2007 Angeletti ..... B65G 49/062 211/195
8,881,898 B2 * 11/2014 DeForest ..... B65D 85/06 211/23
10,294,021 B2 * 5/2019 Ni ..... B65D 90/08
10,676,274 B1 * 6/2020 Broussard ..... B65D 90/08
2003/0164318 A1 * 9/2003 Lacasse ..... B65D 85/48 206/448
2004/0168946 A1 * 9/2004 Angeletti ..... B65G 49/062 206/386
2005/0183375 A1 * 8/2005 Yamamoto ..... B65D 19/10 52/633
2006/0196838 A1 * 9/2006 Mercure ..... A47F 7/0042 211/169
2009/0078665 A1 * 3/2009 Sandusky ..... B65D 19/08 211/208
2018/0057204 A1 * 3/2018 Johnson ..... B65D 19/385

FOREIGN PATENT DOCUMENTS

WO WO 00/17068 A1 3/2000
WO WO 2016/108248 A1 7/2016

* cited by examiner

[Fig. 2]

[Fig. 3]
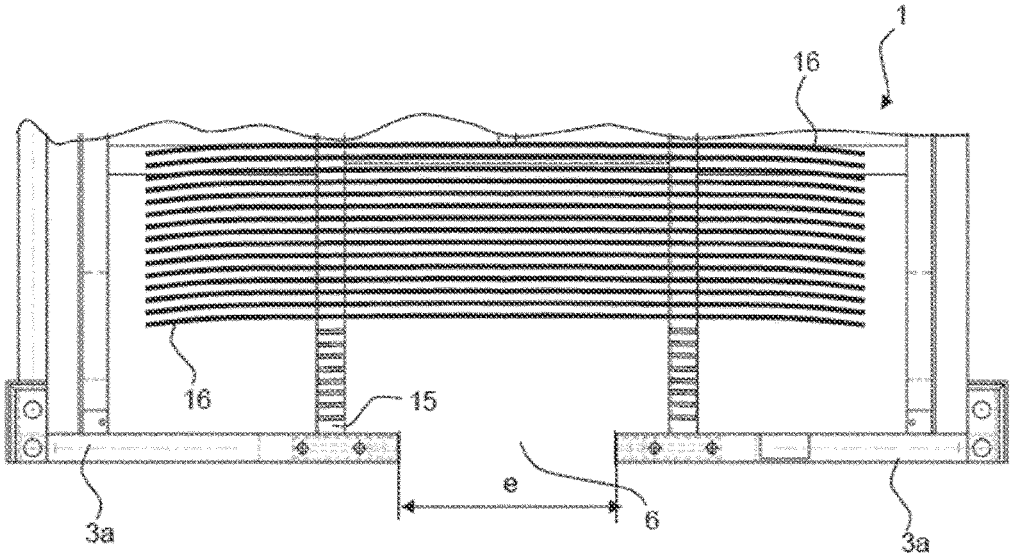
[Fig. 4]
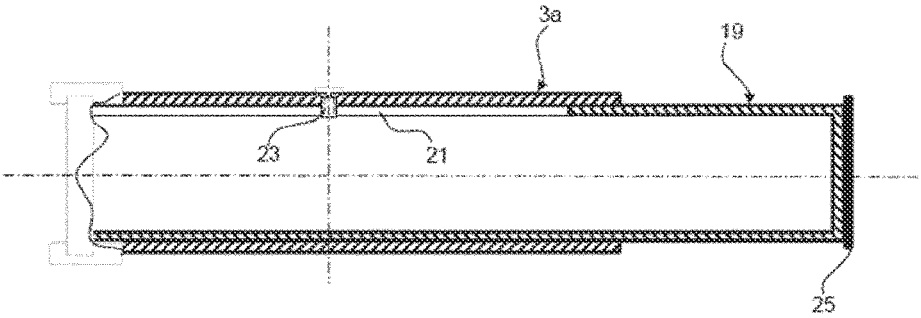
[Fig. 5]
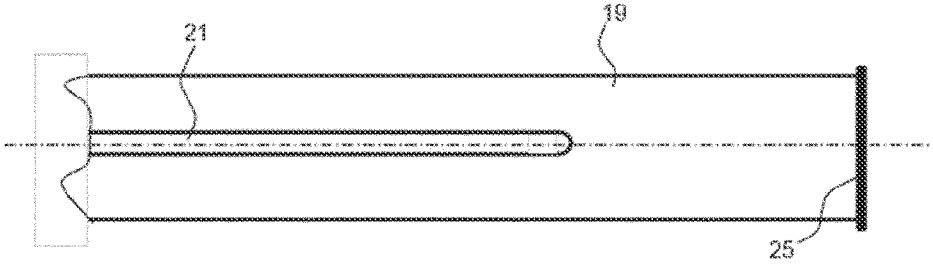

[Fig. 6]
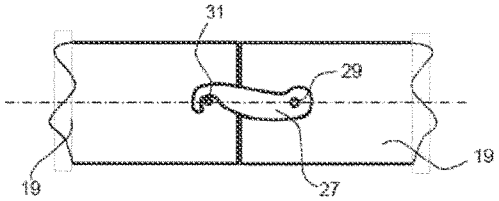
[Fig. 7]
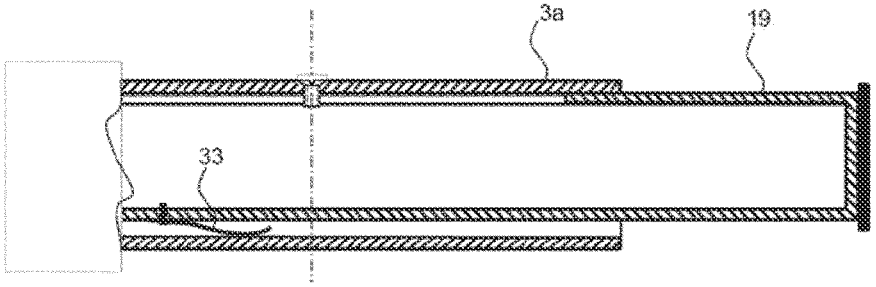
[Fig. 8]
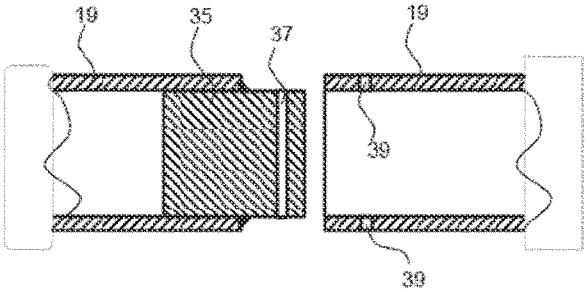
[Fig. 9]
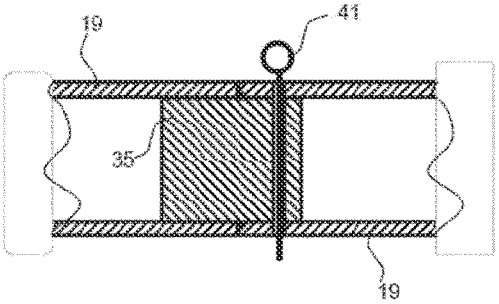

[Fig. 10]
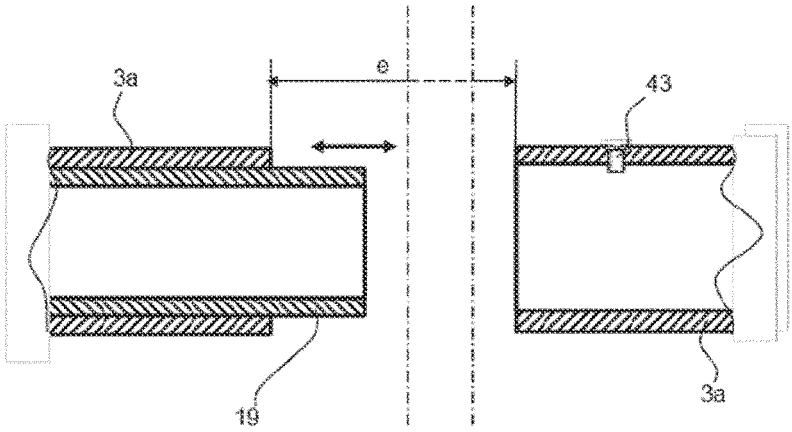
[Fig. 11]
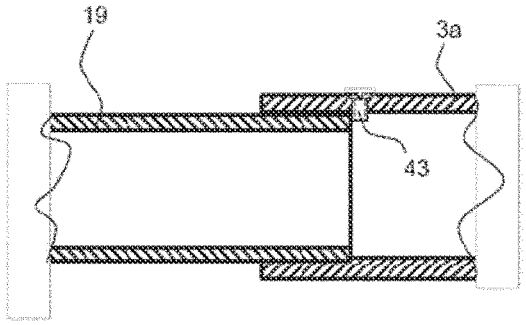
[Fig. 12]
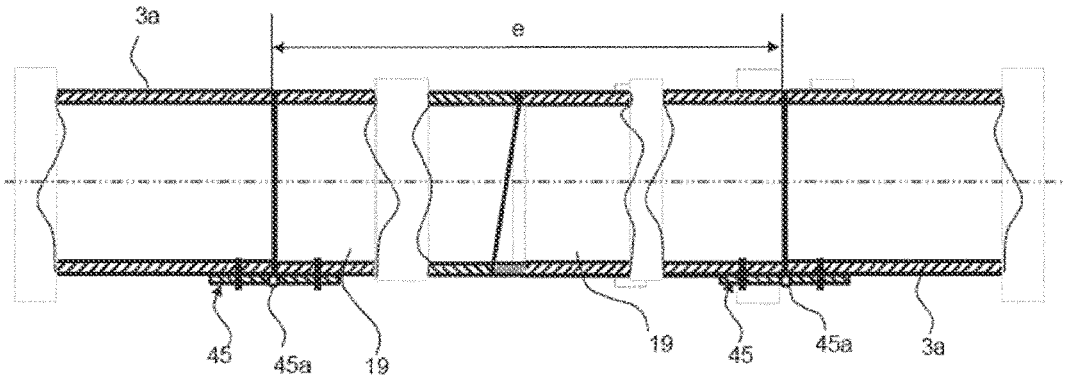

[Fig. 13]
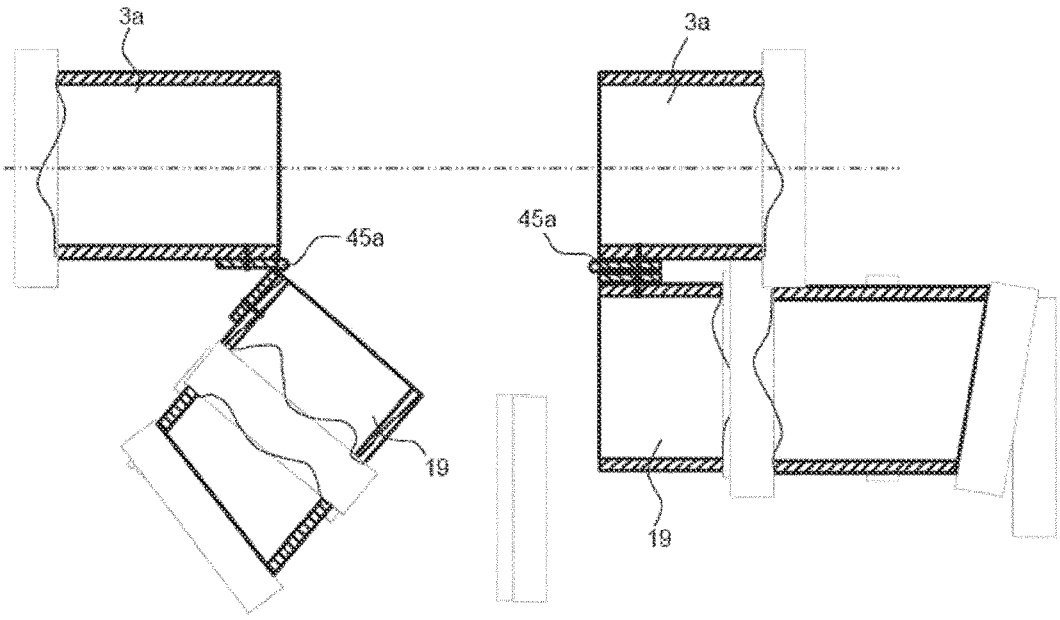

EASY-ACCESS STORAGE RACK

CROSS-REFERENCE TO RELATED APPLICATIONS

This application is the U.S. National Stage of PCT/EP2020/058396, filed Mar. 25, 2020, which in turn claims priority to French patent application number 1903198 filed Mar. 27, 2019. The content of these applications are incorporated herein by reference in their entireties.

FIELD

The present invention relates to a rack intended for storing and/or transporting glazing elements, in particular glazings intended for motor cars, such as for example windshields, back windows or side windows.

BACKGROUND

It is known that racks of this type are generally made up of mechanically welded tubular elements which form a receiving cradle in which the glazing elements come to be deposited such that they rest on their edge, parallel to one another.

It is understood that, so as to fill the rack with the glazing elements, the operator, whether manual or automated, comes to be placed facing the front face of the rack and begins to fill the latter, starting with its rear part and continuing the filling toward its front part. As a result, in particular at the start of filling, this positioning creates serious overhang problems insofar as the operator is remote from the zone where the glazing element is to be deposited. These overhang problems are particularly harmful, over time, to the good health of the operator, in the event that the installation is performed manually, or produce mechanical stresses in the equipment in the event that the installation is performed mechanically.

SUMMARY

The aim of the present invention is to remedy these drawbacks by proposing a rack which makes it possible to improve the positioning of the operator relative thereto and to minimize the overhang positioning thereof during the operation of filling or emptying the rack.

The subject of the present invention is thus a rack for storing and/or transporting elements, in particular glazing elements, of the type comprising a structure provided with receiving means capable of receiving and holding these elements and with frontal protection means.

This rack is characterized in that the protection means are able to occupy two positions, namely a deployed position in which they block access to the interior of the rack and a retracted position in which they allow free access to the latter.

In the deployed position, the main function of these frontal protection means is to allow straps for holding the glazing elements to pass through, said straps being deployed in a transverse median plane. In the absence of such frontal protection elements, an operator would have to position such straps inside the two openings (7*a*, 7*b*) formed in the front baseboards (5*a*, 5*b*). However, such a positioning of the straps would have the double drawback of making it more difficult to insert the pallet truck forks into these openings and of significantly increasing the wear on the straps during these same insertions. The claimed invention offers a solution to this technical problem.

The retractable nature of these frontal protection means also makes it possible to ensure that the latter remain fixed to the rack during the loading/unloading operations. In the context of factory use, where the positioning of each mechanical element has to be able to be predefined and controlled throughout the loading/unloading phases, in particular in order to comply with safety constraints, such a retractable nature of the frontal protection means affords a definite advantage.

According to the invention, the structure may comprise a base formed by a frame, the front part of which comprises a baseboard, this baseboard and also the front part of the frame being interrupted, substantially at their midpoints, by a controlled-access space.

The front baseboard may have two windows passing through it for admitting the gripping means of a lifting device. The lateral parts of the frame may also be provided with a baseboard which may have two windows passing through it for admitting such gripping means.

The front part of the frame may comprise at least one tubular component and the protection means may be made up of at least one slider mounted so as to slide in this component.

In one embodiment of the invention, the front part of the frame may comprise two tubular components separated by the controlled-access space and the protection means may be made up of two sliders mounted so as to slide in each tubular component.

These sliders may have means capable of securing them when they are in the deployed position. These securing means may be made up of magnetic means capable of holding them when they are both in the deployed position.

The structure of the rack according to the invention may advantageously be made from mechanically welded tubes.

Finally, the protection means may be made up of at least one shutter mounted so as to rotate about a vertical pintle secured to the structure.

BRIEF DESCRIPTION OF THE DRAWINGS

Embodiments of the present invention will be described below, by way of non-limiting example, with reference to the appended drawing in which:

FIG. 2 is a partial top view of the rack shown in FIG. 1, in the storage or transportation position, FIG. 3 is a partial top view of the rack shown in FIG. 1, in the filling or emptying position, FIG. 4 is a partial view in longitudinal cross section of the front crossmember of the rack, which is equipped with a slider according to the invention, FIG. 5 is a partial top view of the slider shown in FIG. 4, FIG. 6 is a partial front view of an alternative embodiment of a means for holding the sliders with which a rack according to the invention is equipped, FIG. 7 is a view in partial cross section of an alternative embodiment of a means for braking the sliders, FIGS. 8 and 9 are views in partial cross section of means for connecting two sliders, respectively before and after securing, FIGS. 10 and 11 are views in partial cross section of a variant of a rack with a single slider, respectively before and after deployment thereof, FIG. 12 is a top view in partial cross section of an embodiment of two sliders in the deployed position, FIG. 13 is a top view in partial cross section of the sliders shown in FIG. 12, the right slider being in the retracted position and the left slider being in the partially retracted position.

DETAILED DESCRIPTION

Figure 1:
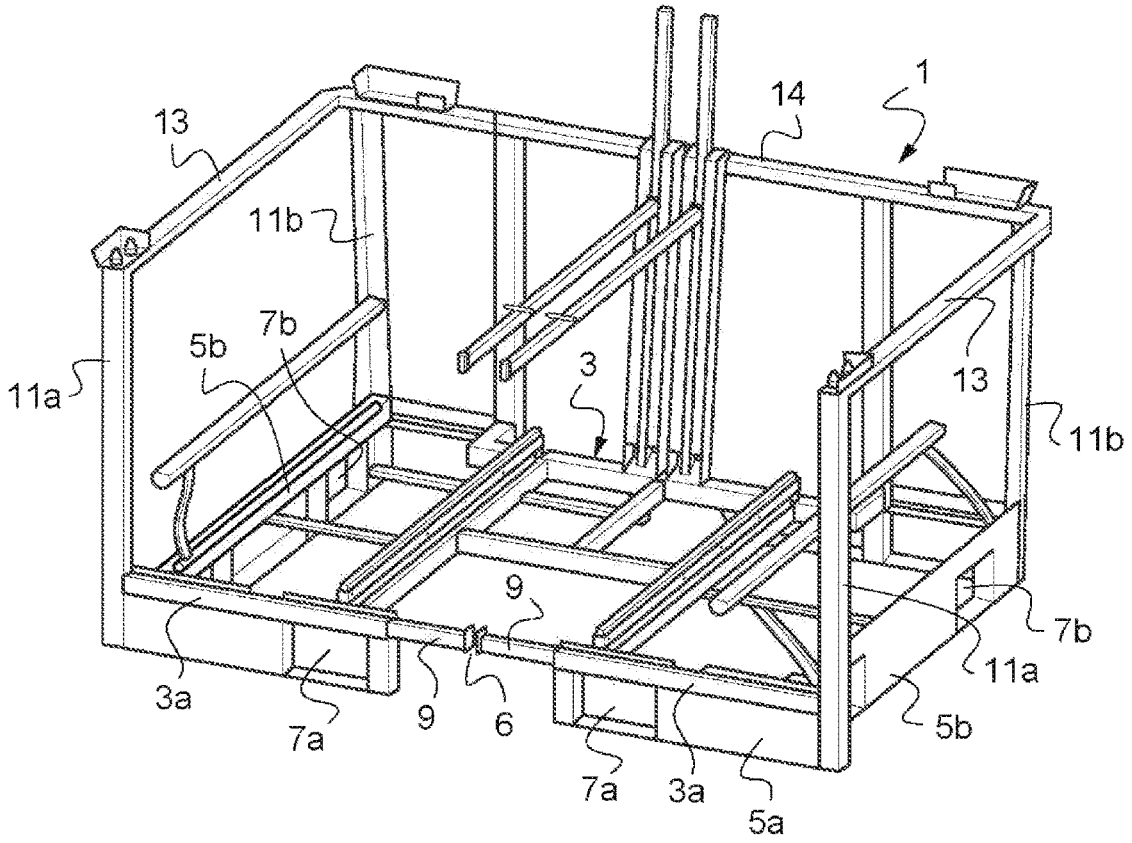
FIG. 1 is a perspective view of a rack provided with access control means according to the invention.
Figure 1:
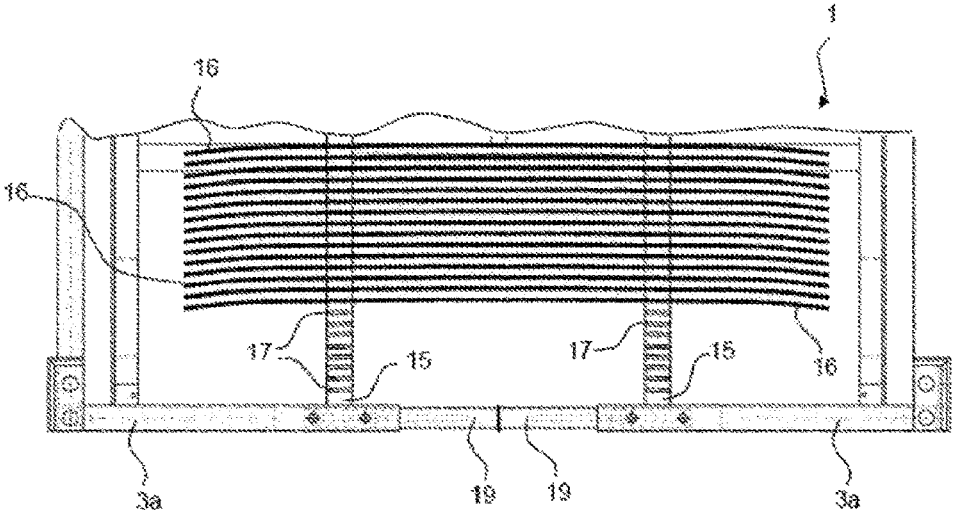

The rack 1 according to the invention, which in the present embodiment is made from mechanically welded tubes, comprises a frame 3 of which the base is rectangular, of which the front face is provided with a baseboard 5*a* which is slightly wider than the frame 3 and of which the lateral faces are provided with a baseboard 5*b*.

The baseboards 5*a* and 5*b* respectively have two openings 7*a* and 7*b* passing through them which are intended to allow the forks of a lifting operator of the pallet truck type to pass through. The part of the front baseboard 5*a* and the front part 3*a* of the frame 3 which are situated between the two openings 7*a* are interrupted so as to create a controlled-access space 6 of width e opening onto the interior of the rack 1, as shown in FIG. 3.

The two ends of the front baseboard 5*a* are terminated by front vertical uprights 11*a*, the tops of which are respectively joined by crossmembers 13 to the tops of two raised vertical uprights 11*b* at the rear corners of the frame. Furthermore, the tops of the two rear vertical uprights 11*b* are joined together by a crossmember 14.

The base frame 3 is provided with two transverse uprights 15, the upper face of which is provided over its entire length with transverse notches 17 which are intended to receive the edges of the glazing elements 16, in particular the windshields or the back windows of vehicles, which are intended to be stored/transported, so as to hold them in a substantially vertical position.

According to the invention, the controlled-access space 6 of the rack 1 has means which, when deployed, make it possible on the one hand to shut off the controlled-access space 6 during transportation or storage, and on the other hand to enable straps for holding the glazing elements 16 to pass through. Such means therefore make it possible to protect the glazing elements 16. As they pass into the retracted position, they also make it possible to allow access to this space 6 during loading/unloading operations, which improves access to the glazing elements and in particular to those which are stored in the rear part of the rack.

To this end and as shown in the figures, the front tubes 3*a* of the frame 3 which are situated on either side of the front openings 7*a* each receive a slider 19 which is friction mounted in the tubes and which is thus able to occupy two positions, namely a deployed position (FIG. 2) or transportation/storage position and a retracted position (FIG. 3) or loading/unloading position.

So as to control the deployment of these sliders, and as shown in FIGS. 4 and 5, they have a longitudinal window 21 passing through their upper face and, in line therewith, a screw 23 forming a stop which enters the window 21 passes through the upper wall of the tubes 3*a*. It is understood that the positioning of the screw 23 and the length of the window 21 make it possible to control both the travel over which each slider 19 may be deployed and, conversely, the travel over which it may re-enter the tube 3*a*.

Preferentially, the free ends of the sliders 19 may be provided with damping means which may for example be made up of pads of elastic material 25 such as for example rubber.

In a variant embodiment of the present invention, the free ends of the sliders 19 may be provided with means for holding them when they are in the deployed position. It is thus possible to dispose a magnetized pad at the end of one slider, and an iron pad or a magnetized pad of opposite polarity to the first at the end of the other slider.

It is also possible, as shown in FIG. 6, to mount a hook 27 on the free end of one of the sliders 19, which hook 27 is mounted so as to rotate about a pintle 29 and comes to lock onto a stud 31 of the free end on the other slider during storage/transportation.

It is also possible to provide means for adjusting the level of friction between the sliders 19 and the interior of the tubes 3*a* in which they are mounted so as to slide. For this purpose, as shown in FIG. 7, it is possible to provide a clearance between the sliders 19 and the interior of the tubes 3*a* and to crimp a bending spring 33 which comes to bear on the internal face of the tubes 3*a* onto the sliders 19.

It is also possible to embed a metal insert 35 into the free end of one of the sliders 19, as shown in FIG. 8, which insert 35, in the position for storing/transporting the glazing elements 16, comes to be housed in the free end of the other slider as shown in FIG. 9.

It is possible to produce a vertical hole 37 passing through the insert 35 of one slider and holes 39 passing through the end of the other slider, these holes being created such that they are aligned when the two sliders are in abutment as shown in FIG. 9. It is then possible to immobilize them by means of a pin 41 passing through the holes 37 and 39.

In another embodiment of the present invention which is shown in FIGS. 10 and 11, the rack 1 may have only a single slider 19 which is longer than the controlled-access space 6, which is mounted so as to slide in the tube 3*a* on one side of the rack and of which the free end comes to be housed in the opening of the opposite tube 3*a*, as shown in FIG. 11, in the storage/transportation position. A screw 43 forming a stop passes through this opposite tube 3*a* in order to immobilize the travel of the slider 19.

Of course, according to the invention the sliders may perform a movement other than sliding in order to pass from their deployed position to their retracted position. They may also in particular perform a rotational movement.

Thus, as shown in FIGS. 12 and 13, one of the ends of the two tubular shutter elements 19 may be secured to an element of a hinge 45 of which the other element is fixed to the frame 3*a* such that the pintle 45*a* of this hinge 45 is vertical. Thus each shutter element is able to occupy a deployed position as shown in FIG. 12, in which it closes the entrance to the rack, and a retracted position in which it allows access thereto.

The invention claimed is:

1. A rack for storing and/or transporting elements comprising a structure provided with receiving means capable of receiving and holding the elements and with frontal protection means, wherein the frontal protection means are able to occupy two positions that include a deployed position in which the frontal protection means block access to interior of the rack and a retracted position in which the frontal protection means allow free access to the latter, the structure delimiting a controlled-access space opening onto the interior of the rack, the frontal protection means in the deployed position shutting off the controlled-access space and the frontal protection means in the retracted position allowing access to the controlled-access space.

2. The storage and/or transportation rack as claimed in claim 1, wherein the structure comprises a base formed by a frame, a front part of which comprises a baseboard, said baseboard and the front part of the frame being interrupted, substantially at their midpoints, by the controlled-access space.

3. The storage and/or transportation rack as claimed in claim 2, wherein the baseboard has two windows passing through it for admitting a gripping means of a lifting device.

4. The storage and/or transportation rack as claimed in claim 2, wherein at least the front part of the frame comprises at least one tubular component and the frontal protection means are made up of at least one slider mounted so as to slide in the at least one tubular component.

5. The storage and/or transportation rack as claimed in claim 2, wherein lateral parts of the frame are provided with a baseboard which has two windows passing through it for admitting a gripping means of a lifting device.

6. The storage and/or transportation rack as claimed in claim 2, wherein the front part of the frame is formed by two tubular components separated by the controlled-access space and the frontal protection means are made up of two sliders mounted so as to slide in each tubular component.

7. The storage and/or transportation rack as claimed in claim 6, wherein the two sliders are provided with means capable of securing them when the sliders are in the deployed position.

8. The storage and/or transportation rack as claimed in claim 7, wherein free ends of the sliders are provided with magnetic means capable of holding them when the sliders are both in the deployed position.

9. The storage and/or transportation rack as claimed in claim 1, wherein the structure is made from mechanically welded tubes.

10. The storage and/or transportation rack as claimed in claim 2, wherein the frontal protection means are made up of at least one shutter mounted so as to rotate about a vertical pintle secured to the structure.

11. The storage and/or transportation rack as claimed in claim 1, wherein the elements are glazing elements.

* * * * *